US009878534B2

(12) United States Patent
Irokawa

(10) Patent No.: US 9,878,534 B2
(45) Date of Patent: Jan. 30, 2018

(54) LIQUID EJECTION HEAD

(71) Applicant: SII Printek Inc., Chiba-shi, Chiba (JP)

(72) Inventor: Daiki Irokawa, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 15/463,467

(22) Filed: Mar. 20, 2017

(65) Prior Publication Data

US 2017/0274645 A1 Sep. 28, 2017

(30) Foreign Application Priority Data

Mar. 22, 2016 (JP) ..... 2016-057336

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/2103; B41J 2/2054; B41J 2/2107; B41J 2/2132; B41J 2002/2058; B41J 2/04541; B41J 2/04581
See application file for complete search history.

(56) References Cited

U.S. PATENT DOCUMENTS

2016/0167378 A1* 6/2016 Kimura ..... B41J 2/04586 347/10

FOREIGN PATENT DOCUMENTS

JP 2000-280463 A 10/2000

* cited by examiner

*Primary Examiner* — Thinh H Nguyen
(74) *Attorney, Agent, or Firm* — Brinks Gilson & Lione

(57) ABSTRACT

A liquid ejection head includes: a piezoelectric actuator configured to be deformed depending on a driving pulse applied thereto so as to eject liquid filled in a pressure chamber from a nozzle, a ratio of a first local maximum value which is a largest value among a plurality of local maximum values of an ejection speed of the liquid depending on a pulse width and a second local maximum value which is a second largest value thereamong satisfying a predetermined condition; and a control unit configured to successively apply a first driving pulse and a second driving pulse to the piezoelectric actuator.

8 Claims, 8 Drawing Sheets

| CONDITION | RATIO OF SECONDARY SPEED TO PRIMARY SPEED | DETERMINATION |
|---|---|---|
| No. 1 | 15% | NG |
| No. 2 | 20% | NG |
| No. 3 | 30% | NG |
| No. 4 | 40% | OK |
| No. 5 | 60% | OK |
| No. 6 | 65% | OK |
| No. 7 | 70% | OK |

FIG. 13

LIQUID EJECTION HEAD

RELATED APPLICATIONS

This application claims priority under 35 U.S.C. § 119 to Japanese Patent Application No. 2016-057336 filed on Mar. 22, 2016, the entire content of which is hereby incorporated by reference.

BACKGROUND OF THE INVENTION

Technical Field

The present invention relates to a liquid ejection head.

Related Art

For example, a liquid ejection printing device that ejects liquid such as ink which can be printed on a printing medium is known. Among such liquid ejection printing devices, there is a liquid ejection printing device including an ink jet head employing a so-called ink jet system. The ink jet head is provided with a piezoelectric actuator in which plural long grooves are formed as pressure chambers which are filled with ink. Electrodes are formed on both side walls of each pressure chamber. When a predetermined driving pulse is applied to the electrodes, the side walls are deformed and a volume in the pressure chamber increases. Accordingly, a negative pressure causing ink to flow into the pressure chamber from a manifold is generated. When the application of the driving pulse is stopped, the volume of the pressure chamber is returned to the original volume. Accordingly, a positive pressure is generated in the pressure chamber and ink is ejected from a nozzle.

In the ink jet head, gray scales of printing using a multi-drop system are adjusted. The multi-drop system is a system in which ink is successively ejected to the same point. In the multi-drop system, ink successively ejected to each point may be one continuous ink droplet. According to the multi-drop system, since an amount of ink droplets impacted on each point can be adjusted, gray scales can be expressed on a printing medium.

For example, JP 2000-280463 A describes a driving method of an ink ejection device in which when a time required for a pressure wave to propagate in one way in an ink channel is defined as T, a wave width of a first ejection pulse signal which is initially applied is set to 0.35 T to 0.65 T and a wave width of a second ejection pulse signal or an ejection pulse signal applied subsequent thereto is set to almost T.

SUMMARY OF THE INVENTION

In JP 2000-280463 A, only the time in which a pressure wave propagates in one way is considered. However, in the multi-drop system, since driving pulses are successively applied, resonance of pressure waves based on the driving pulses needs to be considered. For example, when a pressure wave based on an initially applied driving pulse is greatly attenuated, resonance with a pressure wave based on a second driving pulse is weakened. In this case, an ejection speed of an ink droplet which is generated by the first driving pulse and an ejection speed of ink droplets which is generated by the second driving pulse are greatly different from each other and ejection of ink is unstable. In this way, in the related art, since a degree of attenuation of a pressure wave is not considered, there is a problem in that ejection of ink becomes unstable in the multi-drop system.

An object of some aspects of the present invention is to provide a liquid ejection head that can eject liquid stably and successively.

An object of other aspects of the present invention is to provide a liquid ejection head that can achieve operational advantages described in the following embodiments.

To achieve the above object, a first aspect of the present invention is a liquid ejection head including: a piezoelectric actuator configured to be deformed depending on a driving pulse applied thereto so as to eject liquid filled in a pressure chamber from a nozzle, a ratio of a first local maximum value which is a largest value among a plurality of local maximum values of an ejection speed of the liquid depending on a pulse width and a second local maximum value which is a second largest value thereamong satisfying a predetermined condition; and a control unit configured to successively apply a first driving pulse and a second driving pulse to the piezoelectric actuator.

According to the embodiment of the present invention, the liquid ejection head can stably and successively eject liquid.

BRIEF DESCRIPTION OF DRAWINGS

FIG. 13 is a diagram illustrating a correspondence relationship between characteristics of a nozzle and a determination result on whether ejection in multi-drop is successful.

DETAILED DESCRIPTION OF THE INVENTION

Figure 1:
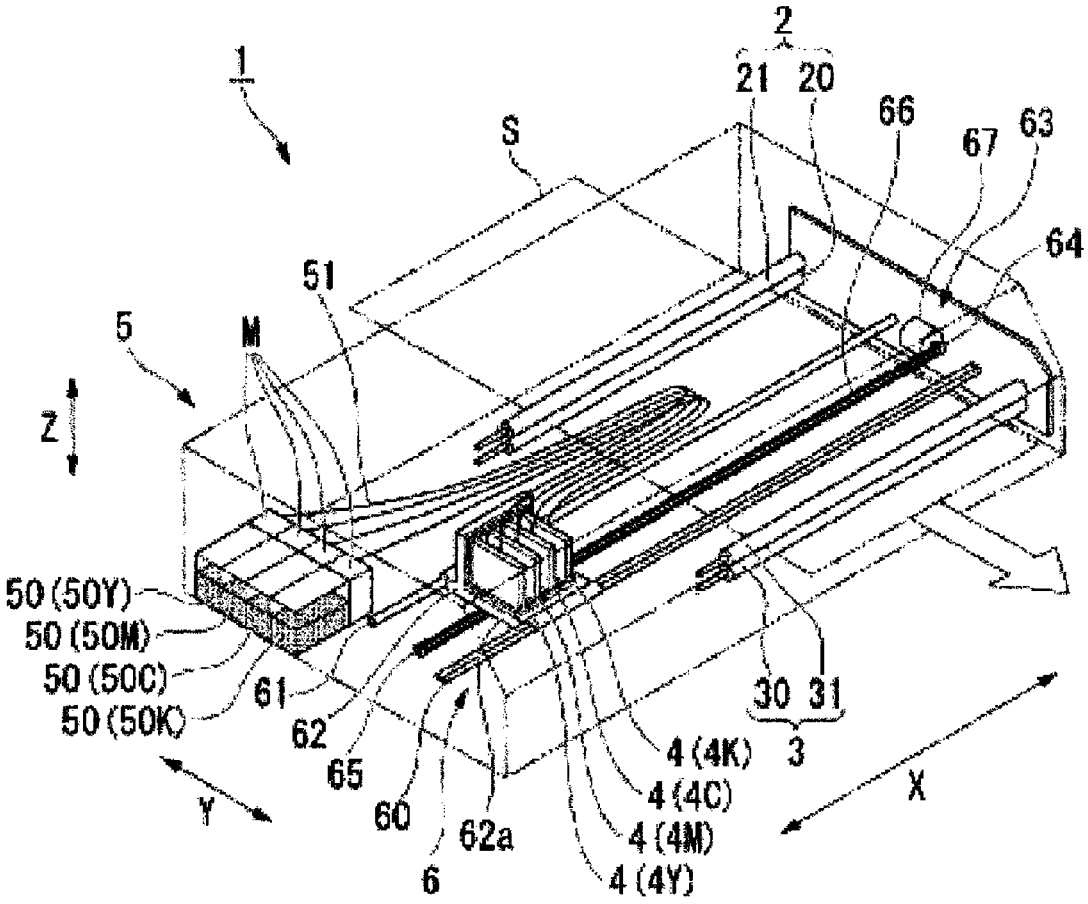
FIG. 1 is a perspective view illustrating a liquid ejection printing device according to an embodiment of the present invention.

Hereinafter, an embodiment of the present invention will be described with reference to the accompanying drawings.

(Liquid Ejection Printing Device)

Hereinafter, an embodiment of the present invention will be described with reference to the drawings. In the drawings which are used in the following description, scales of elements are appropriately changed for the purpose of making the elements in recognizable sizes.

FIG. 1 is a perspective view of a liquid ejection printing device 1.

The liquid ejection printing device 1 includes a pair of conveyance mechanisms 2 and 3 that conveys a printing medium S such as a sheet of paper, a liquid ejection head 4 that ejects ink droplets to the printing medium S, a liquid supply unit 5 that supplies ink to the liquid ejection head 4, and a scanning unit 6 that causes the liquid ejection head 4 to scan in a direction (a sub scanning direction) which is substantially perpendicular to a conveyance direction (a main scanning direction) of the printing medium S.

In the following description, the sub scanning direction is defined as an X direction, the main scanning direction is defined as a Y direction, and a direction perpendicular to both the X direction and the Y direction is defined as a Z direction. The liquid ejection printing device 1 is placed for use such that the X direction and the Y direction are parallel to the horizontal direction and the Z direction is parallel to an upward direction and a downward direction in the gravitational direction.

That is, in a state in which the liquid ejection printing device 1 is placed, the liquid ejection head 4 scans over a printing medium S in the horizontal direction (the X direction and the Y direction). Ink droplets are ejected downward in the gravitational direction (downward in the Z direction) from the liquid ejection head 4 and the ink droplets impacts on the printing medium S.

The pair of conveyance mechanisms 2 and 3 includes grit rollers 20 and 30 that are disposed to extend in the X direction, pinch rollers 21 and 31 that are disposed to extend in parallel to the grit rollers 20 and 30, and a driving mechanism such as a motor that rotationally drives the grit rollers 20 and 30 about an axial direction although details thereof are not illustrated.

The liquid supply unit 5 includes a liquid container 50 that contains ink and a liquid supply pipe 51 that connects the liquid container 50 to the liquid ejection head 4. The liquid container 50 includes plural liquid containers. For example, ink tanks 50Y, 50M, 50C, and 50K in which four types of ink of yellow, magenta, cyan, and black are stored, respectively are disposed in parallel. Each of the ink tanks 50Y, 50M, 50C, and 50K is provided with a pump motor M, and supplies ink to the liquid ejection head 4 via the liquid supply pipe 51 in a pressing manner. The liquid supply pipe 51 is formed of, for example, a flexible hose that can cope with movement of the liquid ejection head 4 (a carriage unit 62).

The liquid container 50 is not limited to the ink tanks 50Y, 50M, 50C, and 50K in which four types of ink of yellow, magenta, cyan, and black are contained, respectively, but may further include ink tanks in which multiple colors of ink is contained.

The scanning unit 6 includes a pair of guide rails 60 and 61 that is disposed to extend in the X direction, a carriage unit 62 that is slidable along the pair of guide rails 60 and 61, and a driving mechanism 63 that causes the carriage unit 62 to move in the X direction. The driving mechanism 63 includes a pair of pulleys 64 and 65 that is disposed between the guide rails 60 and 61, an endless belt 66 that is suspended between the pulleys 64 and 65, and a driving motor 67 that rotationally drives one pulley 64.

The pulleys 64 and 65 are disposed between both ends of the pair of guide rails 60 and 61 and are arranged with an interval in the X direction. The endless belt 66 is disposed between the guide rails 60 and 61 and the carriage unit 62 is connected to the endless belt 66. Plural liquid ejection heads 4 are mounted on a base portion 62*a* of the carriage unit 62. Specifically, liquid ejection heads 4Y, 4M, 4C, and 4K individually corresponding to four types of ink of yellow, magenta, cyan, and black are mounted in parallel in the X direction.

(Liquid Ejection Head)

Figure 2:
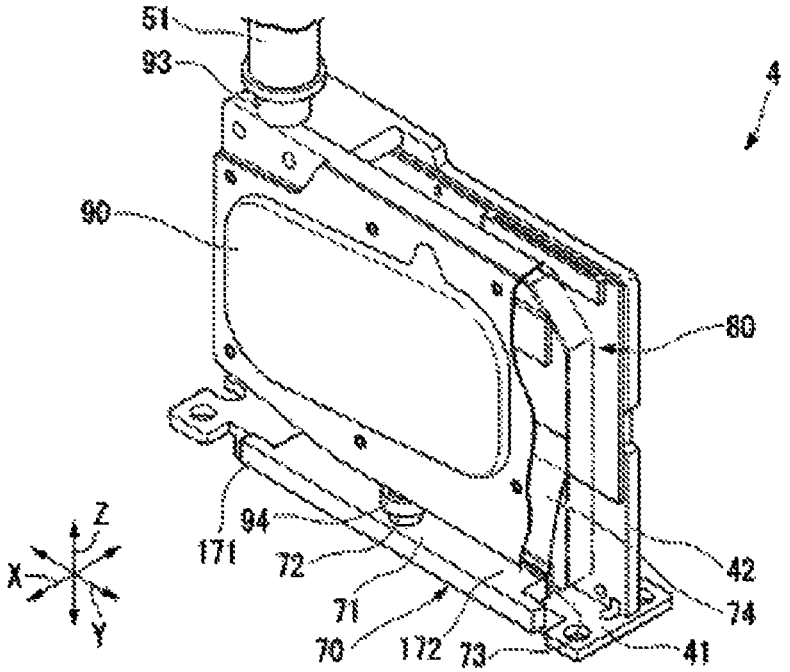
FIG. 2 is a partially exploded perspective view illustrating a liquid ejection head according to the embodiment.

FIG. 2 is a partially exploded perspective view of the liquid ejection head 4.

As illustrated in the drawing, the liquid ejection head 4 includes an ejection unit 70 that ejects ink droplets to a printing medium S (see FIG. 1), a control circuit board 80 that is electrically connected to the ejection unit 70, and a pressure damper 90 interposed between the ejection unit 70 and the liquid supply pipe 51 with connection portions 93 and 94 disposed therebetween on bases 41 and 42. The pressure damper 90 causes ink to flow from the liquid supply pipe 51 to the ejection unit 70 while damping a variation in pressure of ink. The bases 41 and 42 may be formed in a unified body.

The ejection unit 70 includes a channel member 71 that is connected to the pressure damper 90 via a connection portion 72, a liquid ejection head tip 73 that ejects ink as droplets to a printing medium S, and a flexible wire 74 that is electrically connected to the liquid ejection head tip 73 and the control circuit board 80 to apply a voltage to the liquid ejection head tip 73.

(Channel Member)

Figure 3:
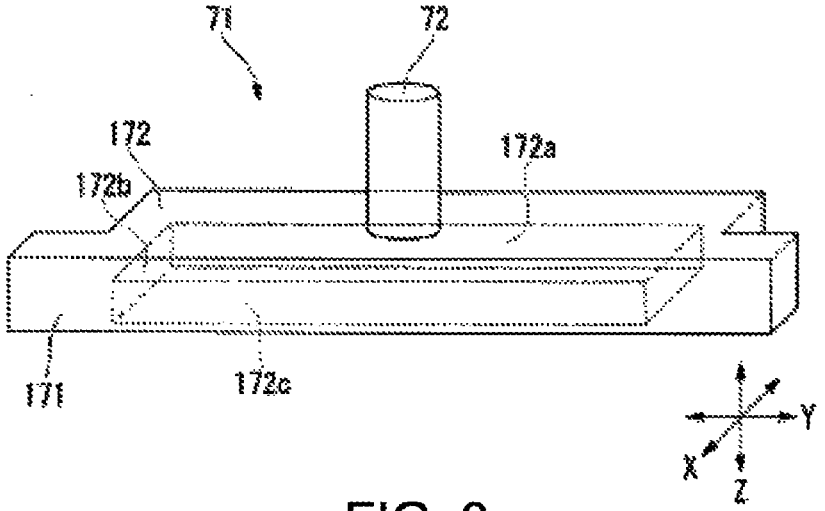
FIG. 3 is a diagram schematically illustrating a configuration of a channel member according to the embodiment.

FIG. 3 is a diagram schematically illustrating a configuration of the channel member 71.

As illustrated in FIG. 3, the channel member 71 causes ink flowing from the connection portion 72 to uniformly spread to the liquid ejection head tip 73. The channel member 71 has a configuration in which a flange portion 171 fixing the channel member 71 and a channel member body 172 are integrally formed and is Ruined to extend in the Y direction.

The channel member body 172 has a substantially box shape in which an opening 172*a* which is long in the Y direction is formed on an end face on the liquid ejection head tip 73 side, that is, on an end face opposite to the flange portion 171. The opening 172*a* communicates with the liquid ejection head tip 73.

The connection portion 72 is connected to an upper side surface 172*b* in the Z direction of the channel member body 172, and the connection portion 72 and the opening 172*a* communicate with each other via a concave portion 172*c* formed in the channel member body 172.

(Liquid Ejection Head Tip)

Figure 4:
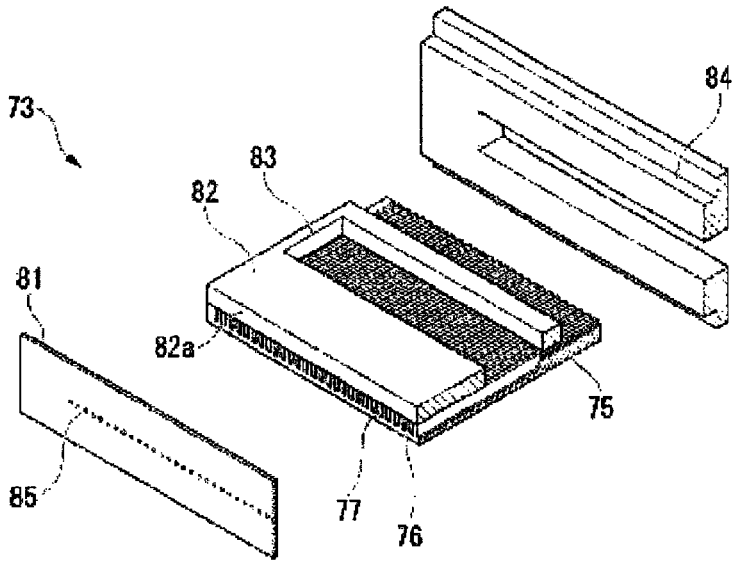
FIG. 4 is an exploded perspective view illustrating a liquid ejection head tip according to the embodiment.
Figure 5:
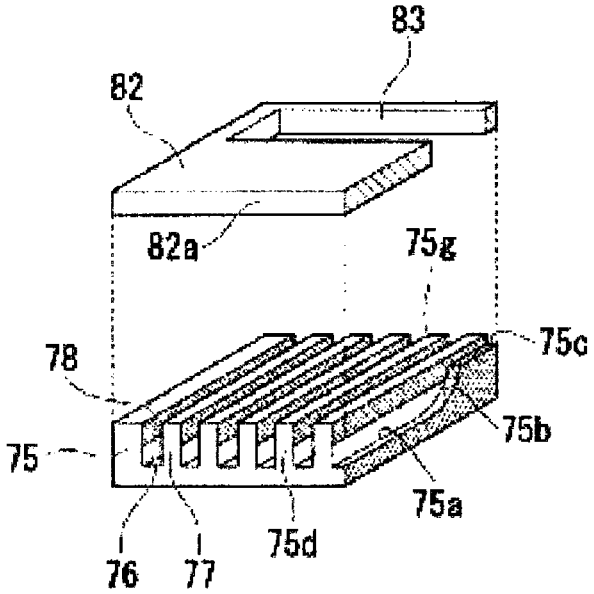
FIG. 5 is a partially enlarged exploded perspective view illustrating a part of the liquid ejection head tip according to the embodiment.

FIG. 4 is an exploded perspective view of the liquid ejection head tip 73. FIG. 5 is a partially enlarged exploded perspective view of the liquid ejection head tip 73.

As illustrated in FIGS. 4 and 5, the liquid ejection head tip 73 includes a substantially rectangular piezoelectric actuator 75. The piezoelectric actuator 75 is formed in a substantially plate shape of, for example, lead zirconate titanate (PZT) to extend in the Y-Z plane. The piezoelectric actuator 75 includes grooves 76 (hereinafter referred to as long grooves 76) that extend in the Z direction on a surface (a top surface 75*g*) of an upper part (a surface on the channel member 71 side in the X direction, a top surface in FIGS. 4 and 5, which is hereinafter simply referred to as an upper part). In the following description, an example in which a part of a pressure chamber for ejecting ink is constituted by the long groove 76 as illustrated in FIGS. 4 and 5 is described, but the shape and configuration of the pressure chamber is not limited to the long groove 76 but may be properly changed.

The long groove 76 has a rectangular cross-sectional surface and is filled with ink. Plural long grooves 76 are arranged over the entire length in the length direction of the piezoelectric actuator 75 and the long grooves 76 are partitioned by side walls 77.

A nozzle plate 81 which is formed of polyimide or the like is disposed on a front end surface 75*d* of the piezoelectric actuator 75. One principal surface of the nozzle plate 81 is a bonding surface to the piezoelectric actuator 75 and the other principal surface is coated with a water repellent film having water repellence or hydrophilicity for preventing attachment of ink thereto.

Plural nozzle openings 85 (hereinafter also referred to as nozzles 85, solely) with a predetermined interval (the same interval equivalent to the pitch of the long grooves 76) in the length direction thereof are formed in the nozzle plate 81. The nozzle openings 85 are formed in the nozzle plate 81 such as a polyimide film or the like, for example, using an excimer laser device. The nozzle openings 85 are arranged to correspond to the positions of the long grooves 76. The nozzle openings 85 are formed in a tapered shape and have a shape which is widened to the long grooves 76.

The long grooves 76 can be classified into ejection grooves which are filled with ink and non-ejection grooves which are not filled with ink. In this case, the nozzles 85 can be formed to be opened at only the positions of the ejection grooves and not to be opened at the positions of the non-ejection grooves.

The top surface 75*g* of the piezoelectric actuator 75 is provided with a rectangular cover plate 82. The length in the short-side direction of the cover plate 82 is set to be smaller than the length in the short-side direction of the piezoelectric actuator 75. A front end surface 82*a* of the cover plate 82 is flush with a front end surface 75*d* of the piezoelectric actuator 75.

A rectangular opening 83 which extends in the length direction is formed in the cover plate 82. The opening 83 extends over the entire long grooves 76 in the length direction of the piezoelectric actuator 75. That is, all the long grooves 76 are opened to the outside via the opening 83 and the long grooves 76 communicate with each other by the opening 83.

The nozzle plate 81 is bonded to a bonding result of the piezoelectric actuator 75 and the cover plate 82. A nozzle support plate 84 that supports the nozzle plate 81 is additionally bonded thereto to constitute the liquid ejection head tip 73. The liquid ejection head tip 73 is disposed to allow the opening 83 of the cover plate 82 and the opening 172*a* of the channel member 71 to communicate with each other, and ink flows into the long grooves 76 via the channel member 71.

The bottom surface of each long groove 76 includes a front flat surface 75*a* that extends from the front side (the lower side in the Z direction) of the piezoelectric actuator 75 to the substantially center in the Z direction, an inclined surface 75*b* of which the depth decreases gradually rearward from the rear end of the front flat surface 75*a*, and a rear flat surface 75*c* that extends rearward from the rear end of the inclined surface 75*b*. The rear end of the long groove 76 is sealed by a sealing portion which is not illustrated.

The side walls 77 of each long groove 76 are provided with driving electrodes 78 over the entire length direction in the vicinity of the upper parts of both principal surfaces using a vapor deposition method. The driving electrodes 78 are electrically connected to the control circuit board 80 via the flexible wire 74 such that a voltage is applied from the control circuit board 80 to the liquid ejection head tip 73. On the basis of this configuration, a predetermined amount of ink is supplied from a storage chamber in the pressure damper 90 to the channel member 71 via the connection portions 72 and 94. The ink spread from the opening 172*a* of the channel member 71 to the opening 83 (the manifold) of the liquid ejection head tip 73. In the following description, a configuration for ejecting ink droplets may be referred to as a nozzle. The nozzle includes members such as the piezoelectric actuator 75, the long grooves 76, the driving electrodes 78, the nozzle plate 81, and the cover plate 82.

(Driving Circuit)

Figure 6:
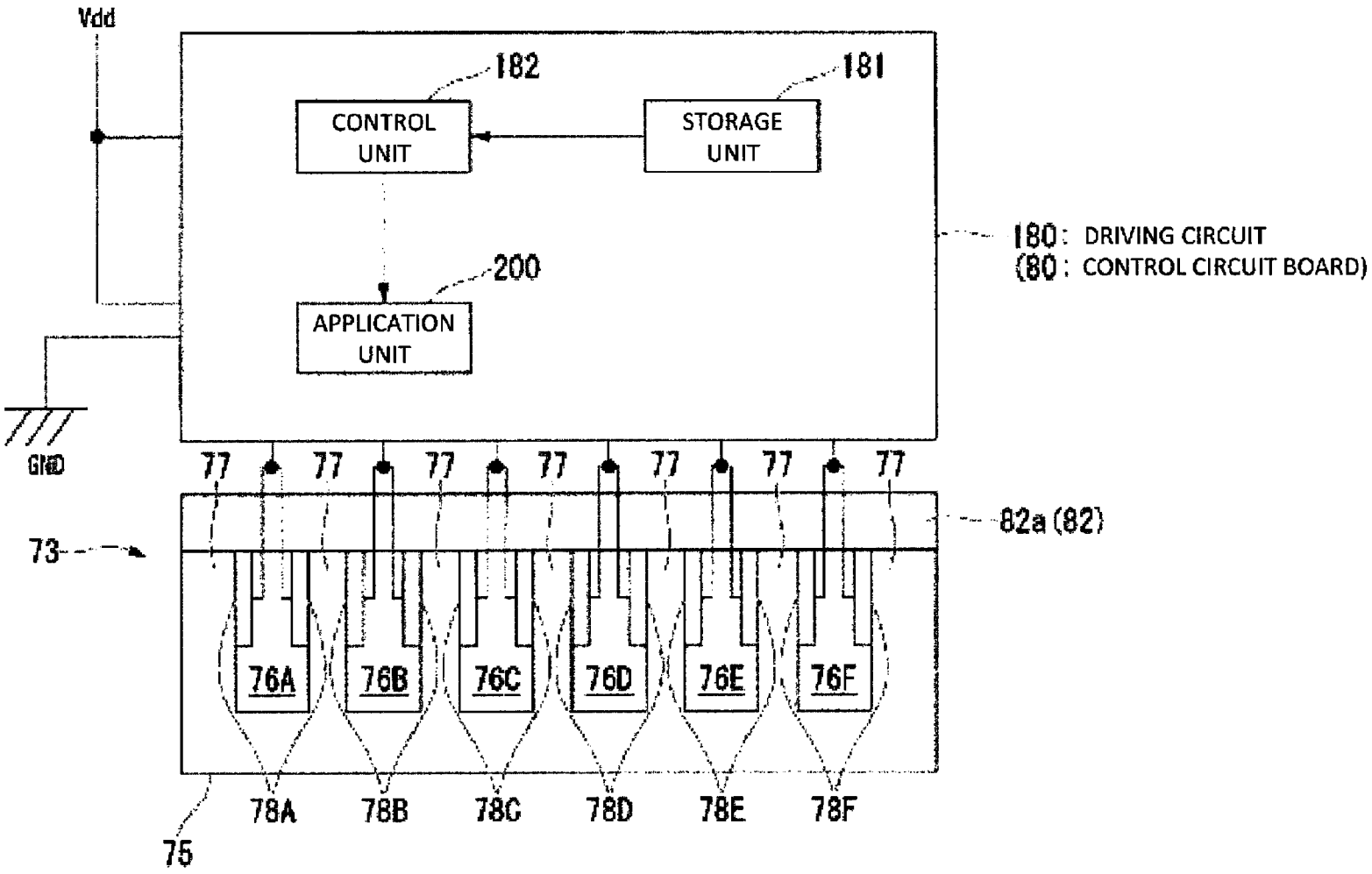
FIG. 6 is a block diagram schematically illustrating an internal configuration of a driving circuit formed on a control circuit board and a connection configuration to the liquid ejection head tip according to the embodiment.

FIG. 6 is a block diagram schematically illustrating an internal configuration of a driving circuit 180 which is formed on the control circuit board 80 for applying a voltage to the liquid ejection head tip 73 and a connection configuration to the liquid ejection head tip 73. In FIG. 6, the number of long grooves 76 illustrated in FIGS. 4 and 5 is actually set to, for example, six, that is, the long grooves are illustrated to be long grooves 76A, 76B, 76C, 76D, 76E, and 76F.

The driving circuit 180 includes a storage unit 181 and a control unit 182.

The storage unit 181 stores waveform information in advance. The waveform information is information on waveform of a driving pulse and includes, for example, identification information of the nozzle (that is, identification information of the nozzles 85, the long grooves 76A to 76F corresponding to the nozzles 85, and driving terminals 200A to 200F), information on the waveform of a driving pulse (such as a voltage value and a pulse width), and information of an ejection speed of ink depending on the waveform. An example in which the voltage value of a driving pulse is set to be constant will be described below.

The control unit 182 receives a print instruction signal for instructing a print job and controls driving of the pump motors M of the ink tanks 50Y, 50M, 50C, and 50K. The print instruction signal is, for example, a signal which is input from an external device or the like connected to the liquid ejection printing device 1, and includes print information indicating a printing target. The control unit 182 generates driving information on the basis of the print information of the received print instruction signal and the waveform information read from the storage unit 181. The control unit 182 controls an application unit 200 on the basis of the generated driving information.

The liquid ejection head 4 may eject an ink droplet by one driving pulse or may eject an ink droplet by plural continuous driving pulses. In the following description, ejection of an ink droplet by plural continuous driving pulses is referred to as multi-drop. When a reference pulse width is defined as (PP), the pulse width of a first driving pulse which is initially applied is set to (PP/2) and the pulse width of a second driving pulse is set to (PP), for example, in the multi-drop. The second driving pulse is applied at a timing at which (3×PP/2) elapses after the first driving pulse is applied. When three or more driving pulses are applied, the second and subsequent driving pulses are applied with a pulse width of (PP) for every predetermined period of (2PP). Accordingly, in the multi-drop, a single ink droplet which is larger in comparison with a case in which a liquid droplet is ejected by one driving pulse can be ejected.

The application unit 200 applies a driving pulse with a pulse width designated by the control unit 182 to the piezoelectric actuator 75 at a timing designated by the control unit 182. The side walls 77 of the long groove 76 are deformed due to a piezoelectric thickness-share effect. As a result, a pressure wave of ink is generated in the long groove 76 and an ink droplet is ejected from the nozzle 85.

(Multi-Drop)

Suitability and unsuitability of the piezoelectric actuator 75 in the multi-drop will be described below.

Figure 7:
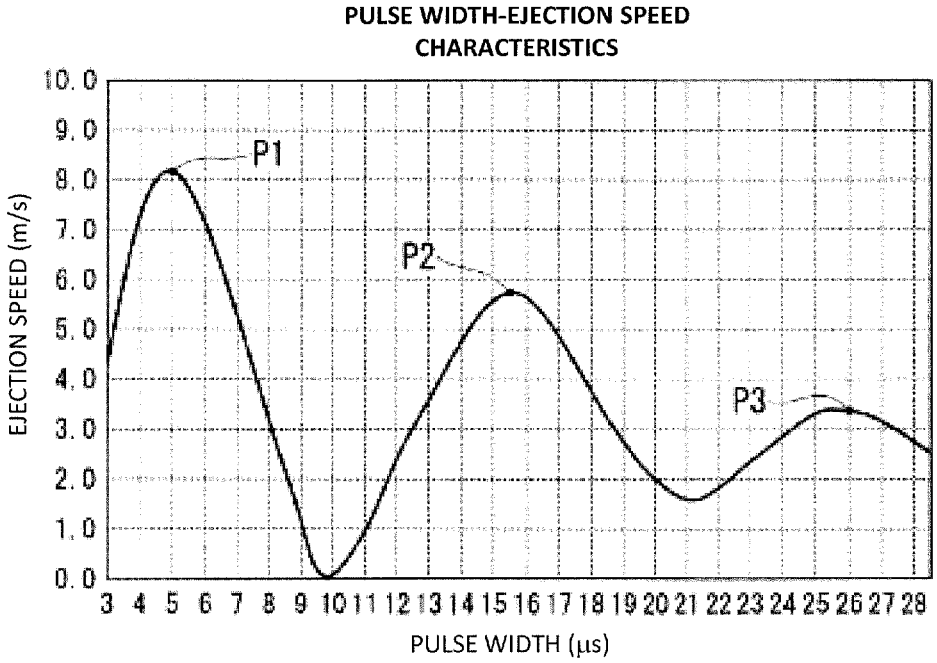
FIG. 7 is a diagram illustrating a relationship between a pulse width and an ejection speed in a piezoelectric actuator which is suitable for multi-drop according to the embodiment.
Figure 8:
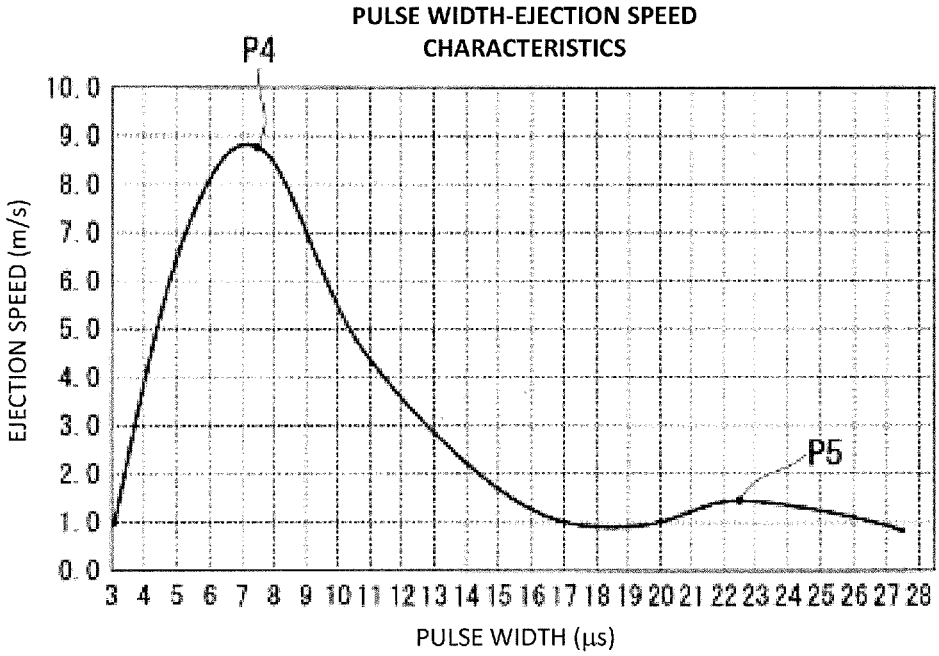
FIG. 8 is a diagram illustrating a relationship between a pulse width and an ejection speed in a piezoelectric actuator which is unsuitable for multi-drop according to the embodiment.

FIG. 7 is a diagram illustrating a relationship between the pulse width and the ejection speed in the piezoelectric actuator 75 which is suitable for the multi-drop. FIG. 8 is a diagram illustrating a relationship between the pulse width and the ejection speed in the piezoelectric actuator 75 which is unsuitable for the multi-drop.

In FIGS. 7 and 8, the horizontal axis represents the pulse width (micro seconds (μs))of a driving pulse and the vertical axis represents the ejection speed (meter/seconds (m/s)) of ink. In FIGS. 7 and 8, the voltage value of the driving pulse is constant. As illustrated in FIG. 7, the piezoelectric actuator 75 which is suitable for the multi-drop exhibits plural peaks (local maximum values) in the ejection speed. In the following description, the peaks are referred to as a first peak, a second peak, . . . in an ascending order in pulse width. The local maximum value of the ejection speed decreases with an increase in the pulse width. In the example illustrated in FIG. 7, the first peak P1 is a point at which the ejection speed is about 8 [m/s] and the pulse width is about 5.2 [μs]. The second peak P2 is a point at which the ejection speed is about 5.5 [m/s] and the pulse width is about 15.6 [μs]. The third peak P3 is a point at which the ejection speed is about 3.2 [m/s] and the pulse width is about 26.0 [μs]. In this way, the first peak, the second peak, and the third peak appear with a predetermined cycle.

On the other hand, for example, the piezoelectric actuator 75 which is unsuitable for the multi-drop as illustrated in FIG. 8 exhibits a remarkably low ejection speed at the second peak. In the example illustrated in FIG. 8, the first peak P4 is a point at which the ejection speed is about 8.5 [m/s] and the pulse width is about 7.5 [μs]. The second peak P5 is a point at which the ejection speed is about 1.5 [m/s] and the pulse width is about 22.5 [μs].

Here, the correspondence relationship between the pulse width and the ejection speed indicates a variation of a pressure wave which is generated in the pressure chamber with application of a driving pulse. This point will be described below. First, when a driving pulse is applied, the piezoelectric actuator 75 is deformed and a pressure wave propagating from the opening 83 to the nozzle 85 is generated in the pressure chamber. When the application of the driving pulse is stopped, the piezoelectric actuator 75 is returned to an original state and a new pressure is applied to the pressure chamber. The pulse width of the first peak indicating the highest ejection speed corresponds to an application time of the driving pulse in which a strongest pressure wave can be generated by expansion and expansion release of the pressure chamber. Accordingly, stable ejection can be performed at a high ejection speed in the vicinity of the pulse width of the first peak. The reference pulse width (PP) is preferably set to 0.8 times to 1.2 times the pulse width of the peak, because there is an error based on the nozzle.

On the other hand, the pressure wave reaching the nozzle 85 is reflected by the side wall in which the nozzle 85 is formed and propagates reversely. Here, the pressure wave propagating reversely may be reflected again, that is, secondary reflection may occur. The pulse width of the second peak corresponds to the application time of the driving pulse in which a combined wave of the second reflected wave of the pressure wave generated by the expansion of the pressure chamber and the pressure wave generated by the expansion release of the pressure chamber can be the strongest. Since the pressure wave is periodically reflected in the pressure chamber, the peak of the ejection speed appears periodically. On the other hand, when reflection of the pressure wave is small, the second peak may decrease remarkably.

Therefore, in the liquid ejection head 4 according to this embodiment, the piezoelectric actuator 75 with which the pressure wave is relatively strongly generated is employed and ejection of an ink droplet is performed using a resonance phenomenon.

Figure 9:
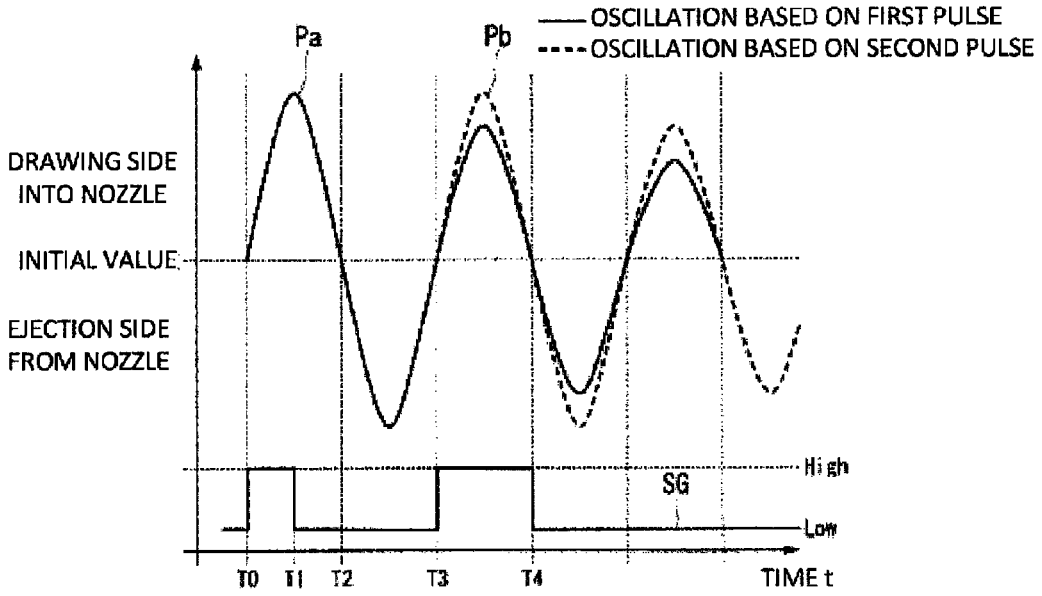
FIG. 9 is a diagram schematically illustrating a relationship between a driving pulse in a piezoelectric actuator which is suitable for multi-drop according to the embodiment and a pressure oscillation in a pressure chamber.
Figure 10:
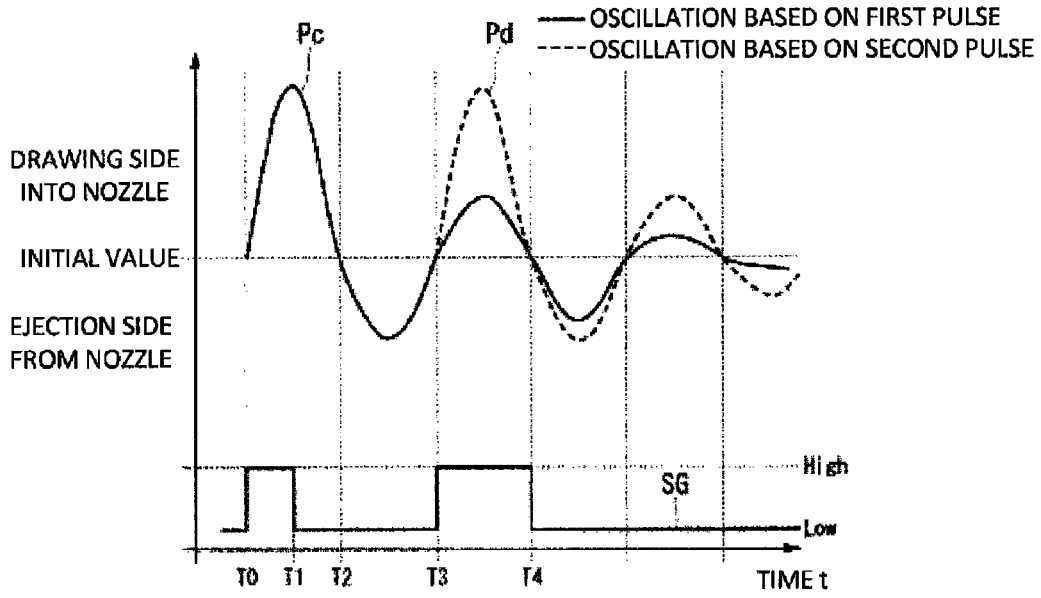
FIG. 10 is a diagram schematically illustrating a relationship between a driving pulse in a piezoelectric actuator which is unsuitable for multi-drop according to the embodiment and a pressure oscillation in a pressure chamber.

FIG. 9 is a diagram schematically illustrating a relationship between a driving pulse in the piezoelectric actuator 75 which is suitable for the multi-drop and a pressure oscillation in the pressure chamber. FIG. 10 is a diagram schematically illustrating a relationship between a driving pulse in the piezoelectric actuator 75 which is unsuitable for the multi-drop and a pressure oscillation in the pressure chamber.

In FIGS. 9 and 10, a graph SG indicates a variation with time of the driving pulses. Graphs Pa and Pc indicate a virtual variation with time of the pressure oscillation generated by a first driving pulse. Graphs Pb and Pd indicate a virtual variation with time of the pressure oscillation generated by a second driving pulse. More specifically, the graphs Pa, Pb, Pc, and Pd indicate positional variations of a meniscus of ink at an ejection end.

In the examples illustrated in FIGS. 9 and 10, two driving pulses of the first driving pulse and the second driving pulse are successively applied. The first driving pulse is applied in a period from time T0 to time T1. The second driving pulse is applied in a period from time T3 to time T4. The time length from time T0 at which application of the first driving pulse is started to time T2 at which the graph Pa exhibits the initial value after exhibiting a first peak corresponds to the pulse width of the first peak. The time length from time T0 at which application of the first driving pulse is started to time T4 at which the graph Pa exhibits a second peak corresponds to the pulse width of the second peak. Further, the time length from time T0 at which application of the first driving pulse is started to time T3 at which the pressure oscillation illustrated by the graph Pa comes at 1 period from time T1 corresponds to the pulse width of a dip (local minimum value) between the first peak and second peak. The pulse width of the first driving pulse is a half (PP/2) of the pulse width of the first peak. The pulse width of the second driving pulse is equal to the pulse width (PP) of the first peak. Here, since the time interval until the second driving pulse is applied after the first driving pulse is applied is short, an ink droplet is not separated from the nozzle 85 by only the first driving pulse.

As indicated by the graph Pa, when the first driving pulse is applied, a pressure wave propagating from the nozzle 85 to the manifold is generated. The pressure wave is reflected by the side wall or the like facing the nozzle 85 and propagates to the nozzle 85. The meniscus of an ink droplet protrudes partially from the nozzle 85 to a printing medium S due to the pressure wave. Then, the pressure wave is reflected by the side wall in which the nozzle 85 is formed and propagates reversely. Thereafter, the pressure wave is attenuated while repeating the reflection.

Here, the application of the second driving pulse is started at time T3 at which the pressure wave based on the first driving pulse oscillates in one cycle. Accordingly, the pressure wave based on the second driving pulse resonates without being cancelled by the pressure wave based on the first driving pulse. That is, by applying the second driving pulse after time T3, the pressure wave based on the first driving pulse and attenuated by the reflection can be enhanced. In this embodiment, the application of the second driving pulse is terminated at time T4 at which the pressure wave based on the first driving pulse oscillates in 1.5 cycles. Accordingly, a new pressure is applied to the inside of the pressure chamber, and the protruding part of the ink droplet caused by the first driving pulse and an ink droplet generated by the re-arriving pressure wave are combined and ejected from the nozzle 85.

Here, in the multi-drop, an ink droplet having a volume larger than that in a case in which an ink droplet is ejected by one driving pulse. Accordingly, in the multi-drop, a large pressure which is not obtained by only applying one driving pulse needs to be applied. However, as illustrated in FIG. 10, in the nozzle which is unsuitable for the multi-drop, the pressure wave is greatly attenuated by the reflection. Accordingly, even when the pressure waves based on two driving pulses are superimposed using resonance of a pressure wave, a large pressure enough to eject a large ink droplet cannot be generated.

On the other hand, as illustrated in FIG. 9, in the nozzle which is suitable for the multi-drop, the pressure wave is less attenuated by the reflection. Accordingly, a large pressure enough to eject a large ink droplet can be generated using resonance of a pressure wave. As a result, the liquid ejection head 4 can perform stable ejection even in the multi-drop.

Figure 11:
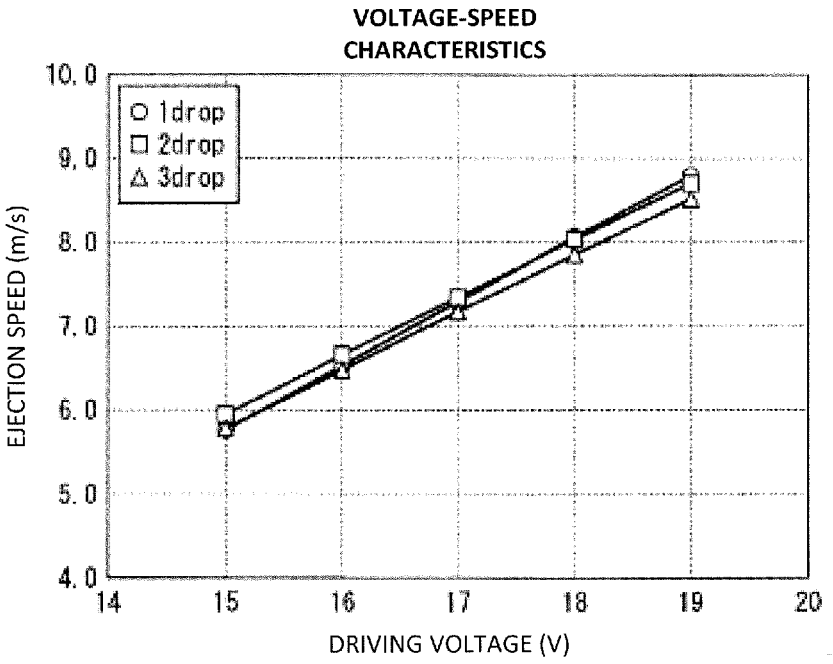
FIG. 11 is a diagram illustrating a comparison result of a relationship between an ejection speed in a nozzle which is suitable for multi-drop and a voltage of a driving pulse for each driving pulse.
Figure 12:
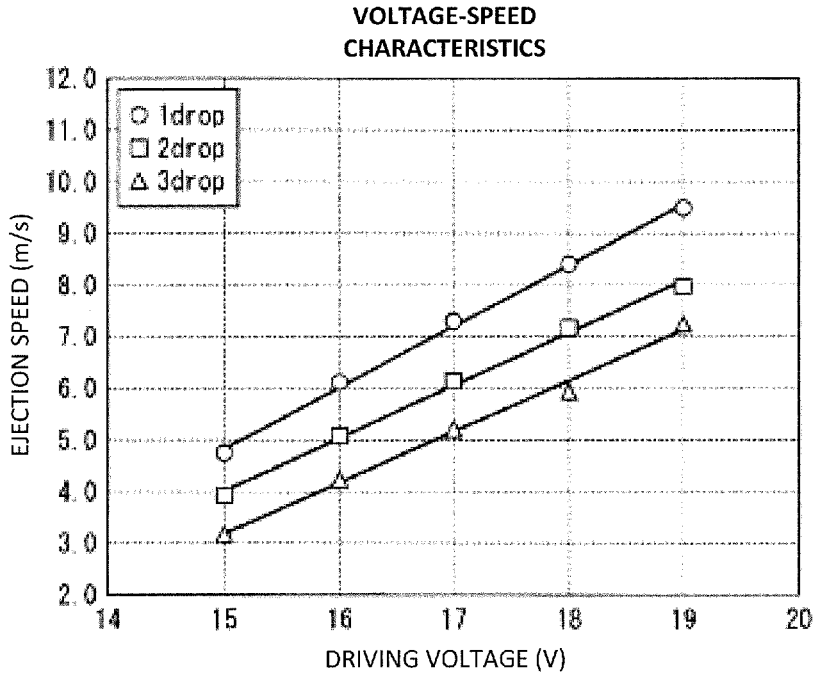
FIG. 12 is a diagram illustrating a comparison result of a relationship between an ejection speed in a nozzle which is unsuitable for multi-drop and a voltage of a driving pulse for each driving pulse.

FIG. 11 is a diagram illustrating a comparison result of a relationship between the ejection speed in the piezoelectric actuator 75 which is suitable for the multi-drop and a voltage of a driving pulse for each driving pulse. FIG. 12 is a diagram illustrating a comparison result of a relationship between the ejection speed in the piezoelectric actuator 75 which is unsuitable for the multi-drop and a voltage of a driving pulse for each driving pulse.

In FIGS. 11 and 12, the horizontal axis represents a voltage value (volt (V)) of a driving pulse and the vertical axis represents an ejection speed of ink [meter/seconds (m/s)]. In FIGS. 11 and 12, the peak width of the driving pulse is constant. 1 drop, 2 drop, and 3 drop illustrated in FIGS. 11 and 12 indicate the numbers of driving pulses applied.

As illustrated in FIG. 11, in the piezoelectric actuator 75 which is suitable for the multi-drop, when the number of driving pulses increases and the driving pulses having the same voltage value, similar ejection speeds are obtained. On the other hand, as illustrated in FIG. 12, in the piezoelectric actuator 75 which is unsuitable for the multi-drop, when the number of driving pulses increases, the ejection speed decreases and unstable ejection is performed.

FIG. 13 is a diagram illustrating a correspondence relationship between characteristics of the piezoelectric actuator 75 and a determination result on whether ejection in the multi-drop is successful. Here, the determination result when driving pulses having the same waveform are applied to the piezoelectric actuators 75 having different characteristics is illustrated. FIG. 13 illustrates a test result when a groove width of 40 [μm] to 100 [μm], a groove depth of 200 [μm] to 400 [μm], and a pump length of 2 [mm] to 5 [mm] are set as parameters of the long groove 76.

As illustrated in FIG. 13, it can be confirmed that the piezoelectric actuator 75 having a higher ratio of a secondary speed to a primary speed (hereinafter referred to as a secondary ratio) is more successful in ejection in the multi-drop. The primary speed is the ejection speed at the first peak which is the largest peak among a plurality of the peaks. The secondary speed is the ejection speed at the second peak which is the second largest peak among of a plurality of the peaks. The piezoelectric actuator 75 having a high secondary ratio is a piezoelectric actuator 75 in which the pressure wave based on the first driving pulse is less attenuated by the reflection. Particularly, when the secondary ratio is equal to or higher than 40%, any piezoelectric actuator 75 succeeds in ejection in the multi-drop. In this way, it has experimentally and empirically been found that the multi-drop can be stably performed by configuring the piezoelectric actuator 75 such that the secondary ratio is equal to or higher than 40%.

Since each long groove 76 of the piezoelectric actuator 75 has a micro structure, it is very difficult to observe a variation in pressure of the pressure chamber. The variation in pressure of the pressure chamber depends on many parameters such as the shape of the nozzle 85, the shape and material of the long groove 76, the degree of deformation of the piezoelectric actuator 75, and the type of ink, it is not easy to simulate the variation in pressure. However, according to this embodiment, it is possible to easily determine whether the piezoelectric actuator 75 is suitable for the multi-drop by only checking the secondary ratio. By employing the piezoelectric actuator 75 having a high secondary ratio, the liquid ejection head 4 can stably and successively eject liquid.

MODIFIED EXAMPLES

While an embodiment of the present invention has been described above with reference to the drawings, the specific configuration thereof is not limited to the embodiment but includes a design or the like which does not depart from the gist of the invention. The configurations described above in the embodiment can be arbitrarily combined.

For example, the waveform of a driving pulse may be changed. For example, the pulse width of the second driving pulse may not be equal to the pulse width of the first peak. In this case, it is preferable that a pressure be applied at the timing at which the pressure wave based on the second reflection arrives at the nozzle 85. Accordingly, it is preferable that the termination of the second driving pulse matches the timing of the pulse width indicating the second peak. Further, in this case, it is preferable that the pressure wave based on the second driving pulse resonates without being cancelled by the pressure wave based on the first driving pulse. Accordingly, it is preferable that applying of the second driving pulse is started at a timing corresponding to a pulse width indicating the dip between the first peak and the second peak.

In the above-mentioned embodiment, the liquid ejection head 4 including a so-called edge shoot type nozzle in which a nozzle is present at the end of an ink channel has been described, but the present invention is not limited thereto.

The liquid ejection head 4 may include a so-called side shoot type nozzle in which a nozzle is present in the middle way of the ink channel.

The processes of the control unit 182 may be performed by recording a program for realizing the function of the control unit 182 on a computer-readable recording medium and causing a computer system to read and execute the program recorded on the recording medium. Here, "causing a computer system to read and execute the program recorded on the recording medium" includes installing the program in the computer system. The "computer system" mentioned herein includes an operating system (OS) or hardware such as peripherals. The "computer system" may include plural computer devices which are connected via a network including Internet, WAN, LAN, or a communication line such as a dedicated line. Examples of the "computer-readable recording medium" include a portable medium such as a flexible disk, a magneto-optical disk, a ROM, or a CD-ROM and a storage device such as a hard disk built in the computer system. The recording medium storing a program in this way may be a non-transitory recording medium such as a CD-ROM. Examples of the recording medium include a recording medium which is disposed inside or outside to be accessible by a delivery server for delivering the program. Codes of the program recorded on a recording medium of a delivery server may be different from codes of a type of program which can be executed by a terminal device. That is, so long as the program can be downloaded from the delivery server and can be installed in the form which can be executed by the terminal device, the type stored in the delivery server does not matter. A configuration in which the program is divided into program parts and the program parts are downloaded at different timings and are then combined by the terminal device may be employed, or delivery servers delivering the divided program parts may be different from each other. The "computer-readable recording medium" may include a medium that holds a program for a predetermined time like a volatile memory (RAM) in a computer system serving as a server or a client when the program is transmitted via a network. The program may serve to realize a part of the above-mentioned functions. The program may be a so-called a differential file (differential program) that can realize the above-mentioned functions in combination with another program stored in advance in the computer system.

All or a part of the above-mentioned functions of the control unit 182 may be embodied by an integrated circuit such as a large scale integration (LSI). The above-mentioned functions may be independently made into individual processors, or all or a part thereof may be integrated as a processor. The circuit integrating technique is not limited to the LSI, but a dedicated circuit or a general-purpose processor may be used. When a circuit integrating technique capable of substituting the LSI appears with advancement of semiconductor technology, an integrated circuit based on the technique may be used. The storage unit 181 and the control unit 182 in the above-mentioned embodiment may be embodied on a control circuit board outside the liquid ejection head 4 (for example, on the liquid ejection printing device 1 side).

What is claimed is:

1. A liquid ejection head comprising:

a piezoelectric actuator configured to be deformed depending on a driving pulse applied thereto so as to eject liquid filled in a pressure chamber from a nozzle, a ratio of a first local maximum value which is a largest value among a plurality of local maximum values of an ejection speed of the liquid depending on a pulse width and a second local maximum value which is a second largest value thereamong satisfying a predetermined condition; and a control unit configured to successively apply a first driving pulse and a second driving pulse to the piezoelectric actuator.

2. The liquid ejection head according to claim 1, wherein the predetermined condition is a configuration that a ratio of the second local maximum value to the first local maximum value is equal to or greater than 40%.

3. The liquid ejection head according to claim 2, wherein the control unit terminates applying of the second driving pulse at a timing corresponding to a pulse width indicating the second local maximum value.

4. The liquid ejection head according to claim 3, wherein the control unit starts applying of the second driving pulse at a timing corresponding to a pulse width indicating a local minimum value between the first local maximum value and the second local maximum value.

5. The liquid ejection head according to claim 2, wherein the control unit starts applying of the second driving pulse at a timing corresponding to a pulse width indicating a local minimum value between the first local maximum value and the second local maximum value.

6. The liquid ejection head according to claim 1, wherein the control unit terminates applying of the second driving pulse at a timing corresponding to a pulse width indicating the second local maximum value.

7. The liquid ejection head according to claim 6, wherein the control unit starts applying of the second driving pulse at a timing corresponding to a pulse width indicating a local minimum value between the first local maximum value and the second local maximum value.

8. The liquid ejection head according to claim 1, wherein the control unit starts applying of the second driving pulse at a timing corresponding to a pulse width indicating a local minimum value between the first local maximum value and the second local maximum value.

* * * * *